US012104222B2

(12) United States Patent
Murray

(10) Patent No.: US 12,104,222 B2
(45) **Date of Patent: *Oct. 1, 2024**

(54) METHOD AND DEVICE FOR PRODUCING DIRECT REDUCED METAL

(71) Applicant: GREENIRON H2 AB, Sollentuna (SE)

(72) Inventor: Hans Murray, Djursholm (SE)

(73) Assignee: GREENIRON H2 AB, Sollentuna (SE)

( * ) Notice: Subject to any disclaimer, the term of this patent is extended or adjusted under 35 U.S.C. 154(b) by 419 days.

This patent is subject to a terminal disclaimer.

(21) Appl. No.: 17/599,506

(22) PCT Filed: Mar. 31, 2020

(86) PCT No.: PCT/SE2020/050337
§ 371 (c)(1),
(2) Date: Sep. 28, 2021

(87) PCT Pub. No.: WO2020/204797
PCT Pub. Date: Oct. 8, 2020

(65) Prior Publication Data

US 2022/0010405 A1 Jan. 13, 2022

(30) Foreign Application Priority Data

Apr. 1, 2019 (SE) ..... 1950403-4

(51) Int. Cl.
*C22B 5/12* (2006.01)
*C21B 13/00* (2006.01)
*C21B 13/12* (2006.01)

(52) U.S. Cl.
CPC ..... *C22B 5/12* (2013.01); *C21B 13/004* (2013.01); *C21B 13/0073* (2013.01); *C21B 13/12* (2013.01)

(58) Field of Classification Search
CPC ..... C22B 5/12; C21B 13/004; C21B 13/0073; C21B 2100/64; C21B 2100/66;
(Continued)

(56) References Cited

U.S. PATENT DOCUMENTS 3,449,117 A 6/1969 Derham
3,964,898 A * 6/1976 Murray ..... C21B 13/0073 75/10.39
(Continued)

FOREIGN PATENT DOCUMENTS

CN 1353201 A 6/2002
CN 103282520 A 9/2013
(Continued)

OTHER PUBLICATIONS

International Search Report from corresponding International Application No. PCT/SE2020/050337, May 28, 2020, 4 pages.
(Continued)

*Primary Examiner* — Brian D Walck
*Assistant Examiner* — Danielle Carda
(74) *Attorney, Agent, or Firm* — Tucker Ellis LLP

(57) ABSTRACT

A method for producing direct reduced metal material includes charging metal material to be reduced into a furnace space; evacuating an existing atmosphere from the furnace space so as to achieve an underpressure inside the furnace space; providing, in a main heating step, heat and hydrogen gas to the furnace space, so that heated hydrogen gas heats the charged metal material to a temperature high enough so that metal oxides present in the metal material are reduced, in turn causing water vapor to be formed; condensing and collecting the water vapor in a condenser below the charged metal material. The hydrogen gas is provided without recirculation of the hydrogen gas. The also includes a subsequently performed step of removing the reduced metal
(Continued)

material from the furnace space, and storing and/or transporting the reduced metal material under an inert atmosphere.

16 Claims, 5 Drawing Sheets

(58) Field of Classification Search
CPC ..... C21B 13/10; C21B 13/12; C21C 2100/04; Y02P 10/134
USPC ..... 75/443
See application file for complete search history.

(56) References Cited

U.S. PATENT DOCUMENTS

| | | | |
|---|---|---|---|
| 5,387,274 | A | 2/1995 | Dam et al. |
| 5,542,963 | A | 8/1996 | Sherwood |
| 6,569,220 | B1 | 5/2003 | Clark |
| 2001/0003930 | A1 | 6/2001 | Montague et al. |
| 2001/0045142 | A1 | 11/2001 | Hansmann et al. |
| 2002/0007699 | A1 | 1/2002 | Montague et al. |
| 2012/0326363 | A1 | 12/2012 | Millner et al. |
| 2013/0305883 | A1 | 11/2013 | Martinis |
| 2016/0017445 | A1 | 1/2016 | Cheeley |
| 2022/0010405 | A1 | 1/2022 | Murray |
| 2022/0064744 | A1* | 3/2022 | Murray ..... C21B 13/12 |
| 2022/0119914 | A1* | 4/2022 | Murray ..... C21B 13/004 |
| 2023/0002841 | A1* | 1/2023 | Murray ..... C21B 13/0093 |

FOREIGN PATENT DOCUMENTS

| | | | | |
|---|---|---|---|---|
| CN | 106702066 | A | | 5/2017 |
| CN | 207130292 | U | | 3/2018 |
| EP | 1201780 | B1 | | 3/2005 |
| IN | 2001MUM00198 | | | 2/2001 |
| JP | S4716312 | B2 | | 1/1972 |
| JP | S49117313 | A | | 11/1974 |
| JP | S5-083990 | A | * | 7/1975 |
| JP | S50158513 | A | | 12/1975 |
| JP | 04254796 | A | | 9/1992 |
| JP | S47040197 | B | | 12/2004 |
| JP | 2007101021 | A | | 4/2007 |
| JP | 2011094172 | A | | 5/2011 |
| KR | 20110111735 | A | | 10/2011 |
| KR | 1020120074644 | A | | 7/2012 |
| RU | 2033431 | C1 | | 4/1995 |
| RU | 2122035 | C1 | | 11/1998 |
| SE | 382078 | B | | 1/1976 |
| SE | 7406174-8 | B | | 8/1979 |
| WO | 0132941 | A1 | | 5/2001 |
| WO | 2012091422 | A2 | | 7/2012 |
| WO | 2015016950 | A1 | | 2/2015 |

OTHER PUBLICATIONS

Office Action and Russian Search Report from corresponding Application No. PCT/SE2020/050337, dated Jul. 7, 2023, 12 pages with translations.

Amir Peyman Soleymani et al.: "Thermodynamic Study of Cementite Formation in Fe-C-O-H System"; Mineral Processing and Extractive Metallurgy Review, dated Oct. 2013, 11 pages.

* cited by examiner

METHOD AND DEVICE FOR PRODUCING DIRECT REDUCED METAL

The present invention relates to a method and a device for producing direct reduced metal, and in particular direct reduced iron (also known as sponge iron). In particular, the present invention relates to the direct reduction of metal ore under a controlled hydrogen atmosphere to produce such direct reduced metal.

The production of direct reduced metal using hydrogen as a reducing agent is well-known as such. For instance, in SE7406174-8 and SE7406175-5 methods are described in which a charge of metal ore is subjected to a hydrogen atmosphere flowing past the charge, which as a result is reduced to form direct reduced metal.

The present invention is particularly applicable in the case of batchwise charging and treatment of the material to be reduced.

There are several problems with the prior art, including efficiency regarding thermal losses as well as hydrogen gas usage. There is also a control problem, since it is necessary to measure when the reduction process has been finalized.

The present invention solves the above described problems.

Hence, the invention relates to a method for producing direct reduced metal material, comprising the steps: a) charging metal material to be reduced into a furnace space; b) evacuating an existing atmosphere from the furnace space so as to achieve an underpressure inside the furnace space; c) providing, in a main heating step, heat and hydrogen gas to the furnace space, so that heated hydrogen gas heats the charged metal material to a temperature high enough so that metal oxides present in the metal material are reduced, in turn causing water vapour to be formed; and d) condensing and collecting the water vapour formed in step c in a condenser below the charged metal material; which method is characterised in that said hydrogen gas in step c is provided without recirculation of the hydrogen gas, and in that the method further comprises the subsequently performed step of removing the reduced metal material from the furnace space (120), and storing and/or transporting the reduced metal material under an inert atmosphere.

In the following, the invention will be described in detail, with reference to exemplifying embodiments of the invention and to the enclosed drawings, wherein:

FIG. 1*a* is a cross-section of a simplified furnace for use in a system according to the present invention, during a first operation state;

FIG. 1*b* is a cross-section of the simplified furnace of FIG. 1*a*, during a second operation state;

Figure 1A:
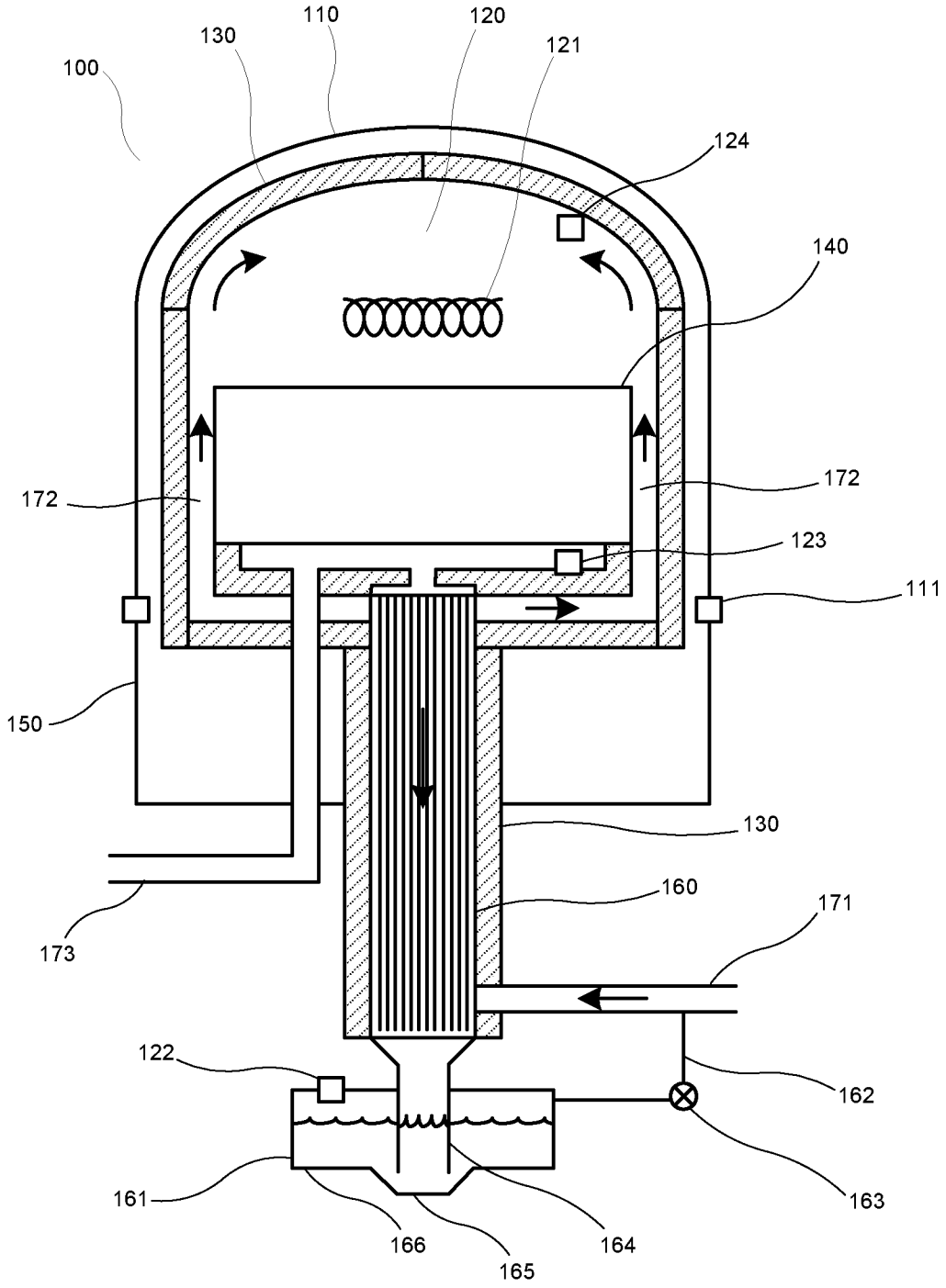
Figure 1B:
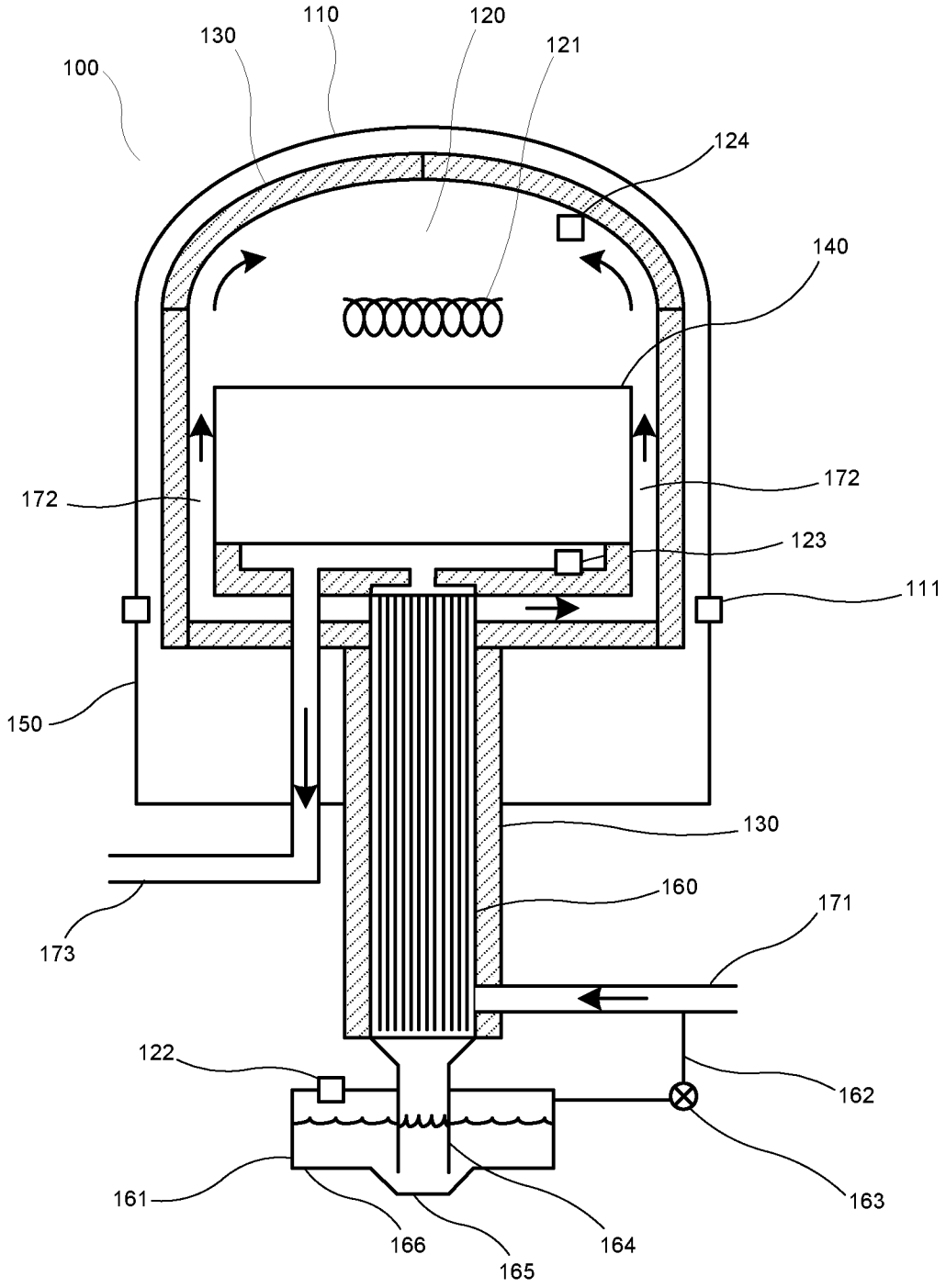

FIGS. 1*a* and 1*b* share the same reference numerals for same parts.

Figure 2:
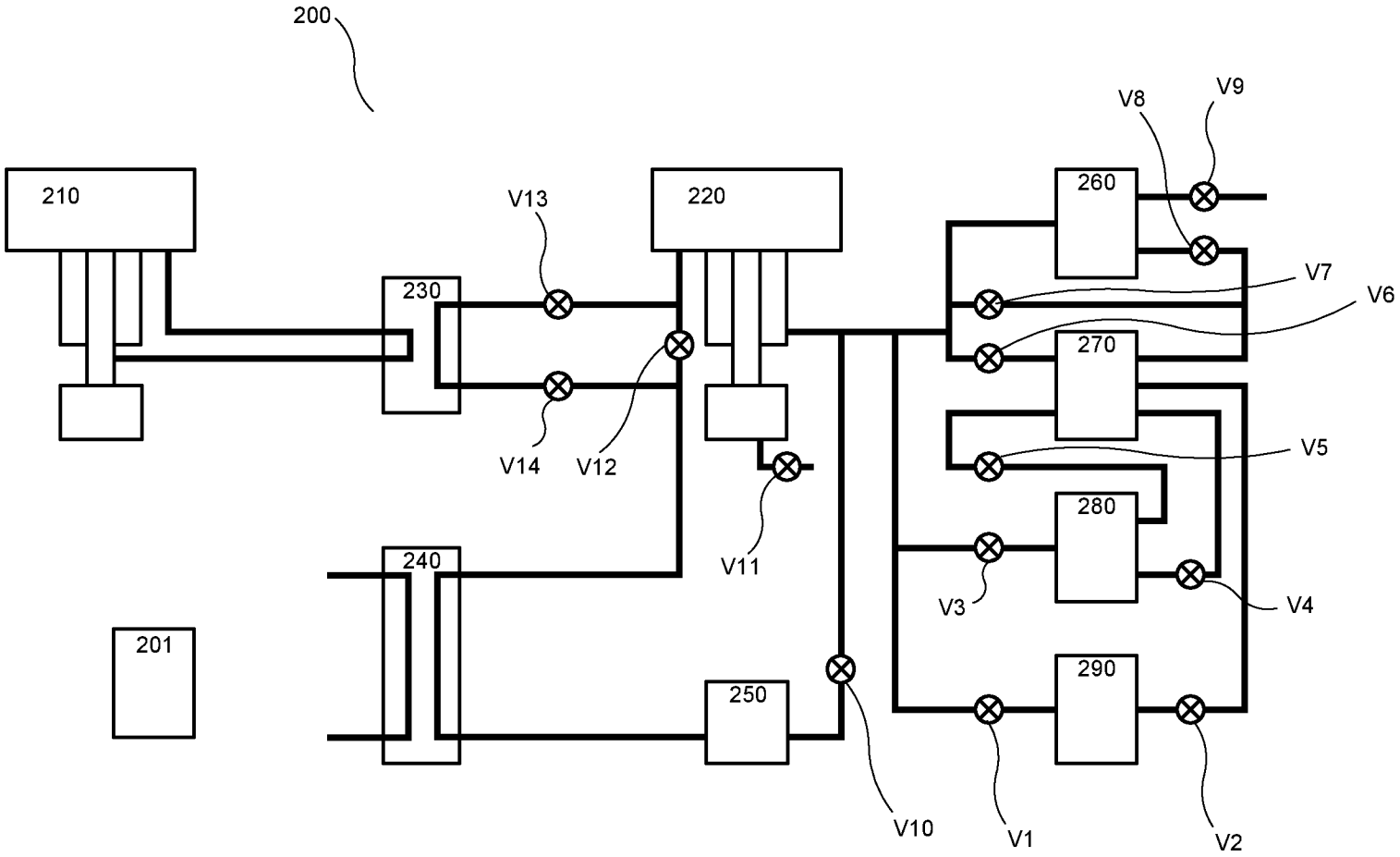
FIG. 2 is a schematic overview of a system according to the present invention.

Hence, FIGS. 1*a* and 1*b* illustrate a furnace 100 for producing direct reduced metal material. In FIG. 2, two such furnaces 210, 220 are illustrated. The furnaces 210, 220 may be identical to furnace 100, or differ in details. However, it is understood that everything which is said herein regarding the furnace 100 is equally applicable to furnaces 210 and/or 220, and vice versa.

Furthermore, it is understood that everything which is said herein regarding the present method is equally applicable to the present system 200 and/or furnace 100; 210, 220, and vice versa.

The furnace 100 as such has many similarities with the furnaces described in SE7406174-8 and SE7406175-5, and reference is made to these documents regarding possible design details. However, an important difference between these furnaces and the present furnace 100 is that the present furnace 100 is not arranged to be operated in a way where hydrogen gas is recirculated through the furnace 100 and back to a collecting container arranged outside of the furnace 100, and in particular not in a way where hydrogen gas is recirculated out from the furnace 100 (or heated furnace space 120) and then back into the furnace 100 (or heated furnace space 120) during one and the same batch processing of charged material to be reduced.

Instead, and as will be apparent from the below description, the furnace 100 is arranged for batch-wise reducing operation of one charge of material at a time, and to operate during such an individual batch processing as a closed system, in the sense that hydrogen gas is supplied to the furnace 100 but not removed therefrom during the batch-wise reducing step.

In other words, the amount of hydrogen gas present inside the furnace 100 always increases during the reduction process. After reduction has been completed, the hydrogen gas is of course evacuated from within the furnace 100, but there is no recirculation of hydrogen gas during the reduction step.

Hence, the furnace 100 is part of a closed system comprising a heated furnace space 120 which arranged to be pressurized, such as to at least 5 bars, or at least 6 bars, or at least 8 bars, or even at least 10 bars. An upper part 110 of the furnace 100 has a bell-shape. It can be opened for charging of material to be processed, and can be closed in a gas-tight manner using fastening means 111. The furnace space 120 is encapsulated with refractory material, such as brick material 130.

The furnace space 120 is arranged to be heated using one or several heating elements 121. Preferably, the heating elements 121 are electric heating elements. However, radiator combustion tubes or similar fuel-heated elements can be used as well. The heating elements 121 do not, however, produce any combustion gases that interact directly chemically with the furnace space 120, which must be kept chemically controlled for the present purposes. It is preferred that the only gaseous matter provided into the furnace space during the below-described main heating step is hydrogen gas.

The heating elements 121 may preferably be made of a heat-resistant metal material, such as a molybdenum alloy.

Additional heating elements may also be arranged in the heated furnace space 120. For instance, heating elements similar to elements 121 may be provided at the side walls of the furnace space 120, such as at a height corresponding to the charged material or at least to the container 140. Such heating elements may aid heating not only the gas, but also the charged material via heat radiation.

The furnace 100 also comprises a lower part 150, forming a sealed container together with the upper part 110 when the furnace is closed using fastening means 111.

A container 140 for material to be processed (reduced) is present in the lower part 150 of the furnace 100. The container 140 may be supported on a refractory floor of the furnace space 120 in a way allowing gas to pass beneath the container 140, such as along open or closed channels 172 formed in said floor, said channels 172 passing from an inlet 171 for hydrogen gas, such as from a central part of the furnace space 120 at said furnace floor, radially outward to a radial periphery of the furnace space 120 and thereafter upwards to an upper part of the furnace space 120. See flow arrows indicated in FIG. 1*a* for these flows during the below-described initial and main heating steps.

The container 140 is preferably of an open constitution, meaning that gas can pass freely through at least a bottom/floor of the container 140. This may be accomplished, for instance, by forming holes through the bottom of the container 140.

The material to be processed comprises a metal oxide, preferably an iron oxide such as $Fe_2O_3$ and/or $Fe_3O_4$. The material may be granular, such as in the form of pellets or balls. One suitable material to be charged for batch reduction is rolled iron ore balls, that have been rolled in water to a ball diameter of about 1-1.5 cm. If such iron ore additionally contains oxides that evaporate at temperatures below the final temperature of the charged material in the present method, such oxides may be condensed in the condenser 160 and easily collected in powder form. Such oxides may comprise metal oxides such as Zn and Pb oxides.

Advantageously, the furnace space 120 is not charged with very large amounts of material to be reduced. Each furnace 100 is preferably charged with at the most 50 tonnes, such as at the most 25 tonnes, such as between 5 and 10 tonnes, in each batch. This charge may be held in one single container 150 inside the furnace space 120. Depending on throughput requirements, several furnaces 100 may be used in parallel, and the residual heat from a batch in one furnace 220 can then be used to preheat another furnace 210 (see FIG. 2 and below).

This provides a system 200 which is suitable for installation and use directly at the mining site, requiring no expensive transport of the ore before reduction. Instead, direct reduced metal material can be produced on-site, packaged under a protecting atmosphere and transported to a different site for further processing.

Hence, in the case of water-rolled iron ore balls, it is foreseen that the furnace 100 may be installed in connection to the iron ore ball production system, so that charging of the metal material into the furnace 100 in the container 140 can take place in a fully automated manner, where containers 140 are automatically circulated from the iron ore ball production system to the system 100 and back, being filled with iron ore balls to be reduced; inserted into the furnace space 120; subjected to the reducing hydrogen/heat processing described herein; removed from the furnace space 120 and emptied; taken back to the iron ore ball production system; refilled; and so forth. More containers 140 may be used than furnaces 100, so that in each batch switch a reduced charge in a particular container is immediately replaced in the furnace 100 with a different container carrying material not yet reduced. Such a larger system, such as at a mining site, may be implemented to be completely automated, and also to be very flexible in terms of throughput, using several smaller furnaces 100 rather than one very large furnace.

Below the container 140, the furnace 100 comprises a gas-gas type heat exchanger 160, which may advantageously be a tube heat exchanger such as is known per se. The heat exchanger 160 is preferably a counter-flow type heat exchanger. To the heat exchanger 160, below the heat exchanger 160, is connected a closed trough 161 for collecting and accommodating condensed water from the heat exchanger 160. The trough 161 is also constructed to withstand the operating pressures of the furnace space 120 in a gas-tight manner.

The heat exchanger 160 is connected to the furnace space 120, preferably so that cool/cooled gases arriving to the furnace space 120 pass the heat exchanger 160 along externally/peripherally provided heat exchanger tubes and further through said channels 172 up to the heating element 121. Then, heated gases passing out from the furnace space 120, after passing and heating the charged material (see below), pass the heat exchanger 160 through internally/centrally provided heat exchanger tubes, thereby heating said cool/cooled gases. The outgoing gases hence heat the incoming gases both by thermal transfer due to the temperature difference between the two, as well as by the condensing heat of condensing water vapour contained in the outgoing gases effectively heating the incoming gases.

The formed condensed water from the outgoing gases is collected in the trough 161.

The furnace 100 may comprise a set of temperature and/or pressure sensors in the trough 161 (122); at the bottom of the furnace space 120, such as below the container 140 (123) and/or at the top of the furnace space 120 (124). These sensors may be used by control unit 201 to control the reduction process, as will be described below.

171 denotes an entry conduit for heating/cooling hydrogen gas. 173 denotes an exit conduit for used cooling hydrogen gas.

Between the trough 161 and the entry conduit 171 there may be an overpressure equilibration channel 162, with a valve 163. In case an overpressure builds up in the trough 161, due to large amounts of water flowing into the trough 161, such an overpressure may then be released to the entry conduit 171. The valve 163 may be a simple overpressure valve, arranged to be open when the pressure in trough 161 is higher than the pressure in the conduit 171. Alternatively, the valve may be operated by control device 201 (below) based on a measurement from pressure sensor 122.

Condensed water may be led from the condenser/heat exchanger 160 may be led down into the trough via a spout 164 or similar, debouching at a bottom of the trough 161, such as at a local low point 165 of the trough, preferably so that an orifice of said spout 164 is arranged fully below a main bottom 166 of the trough 161 such as is illustrated in FIG. 1*a*. This will decrease liquid water turbulence in the trough 161, providing more controllable operation conditions.

The trough 161 is advantageously dimensioned to be able to receive and accommodate all water formed during the reduction of the charged material. The size of trough 161 can hence be adapted for the type and volume of one batch of reduced material. For instance, when fully reducing 1000 kg of $Fe_3O_4$, 310 liters of water is formed, and when fully reducing 1000 kg of $Fe_2O_3$, 338 liters of water is formed.

In FIG. 2, a system 200 is illustrated in which a furnace of the type illustrated in FIGS. 1*a* and 1*b* may be put to use. In particular, one or both of furnaces 210 and 220 may be of the type illustrated in FIGS. 1*a* and 1*b*, or at least according to the present claim 1.

230 denotes a gas-gas type heat exchanger. 240 denotes a gas-water type heat exchanger. 250 denotes a fan. 260 denotes a vacuum pump. 270 denotes a compressor. 280 denotes a container for used hydrogen gas. 290 denotes a container for fresh/unused hydrogen gas. V1-V14 denote valves.

201 denotes a control device, which is connected to sensors 122, 123, 124 and valves V1-V14, and which is generally arranged to control the processes described herein. The control device 201 may also be connected to a user control device, such a graphical user interface presented by a computer (not shown) to a user of the system 200 for supervision and further control.

Figure 3:
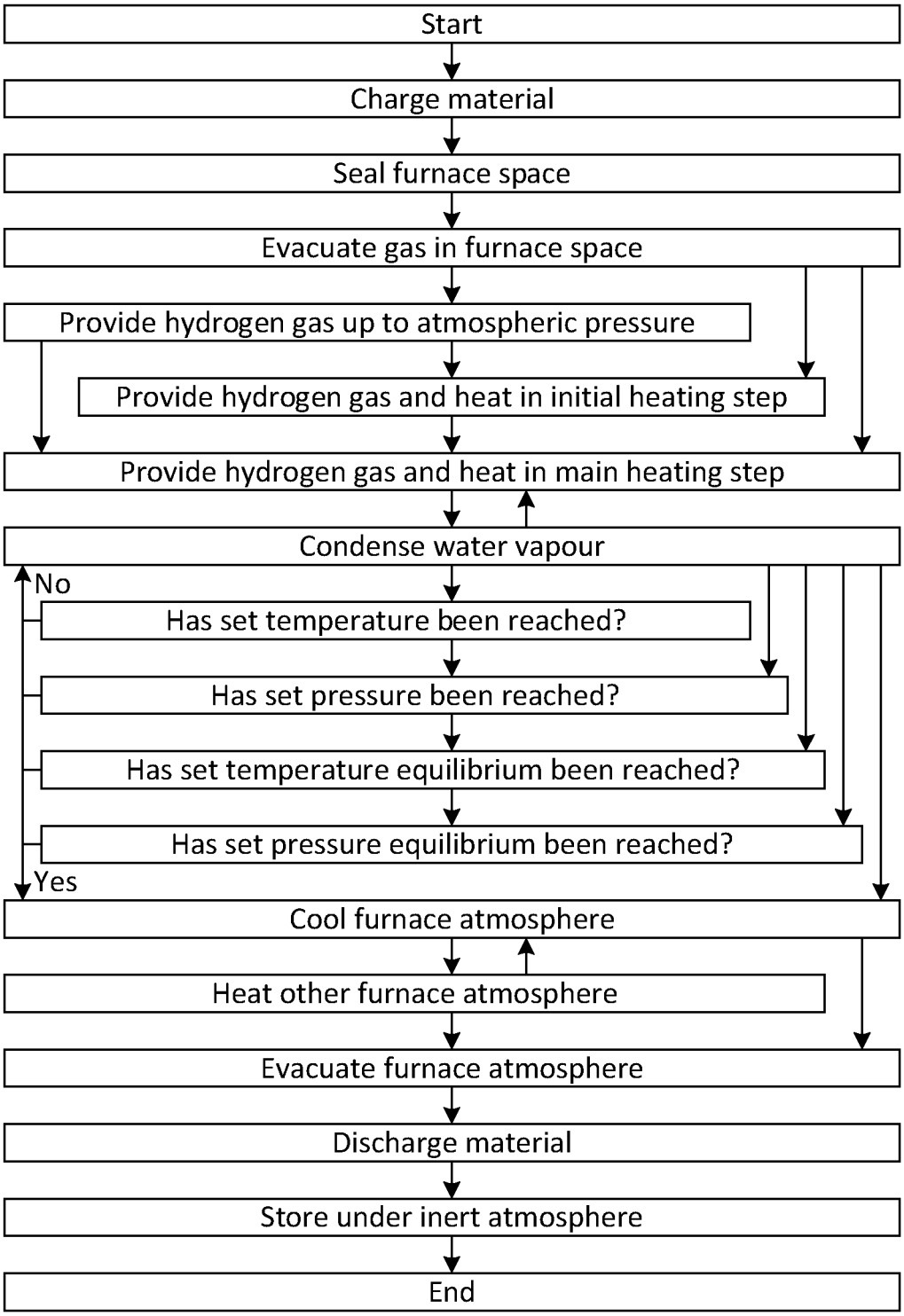
FIG. 3 is a flowchart of a method according to the present invention.
Figure 4:
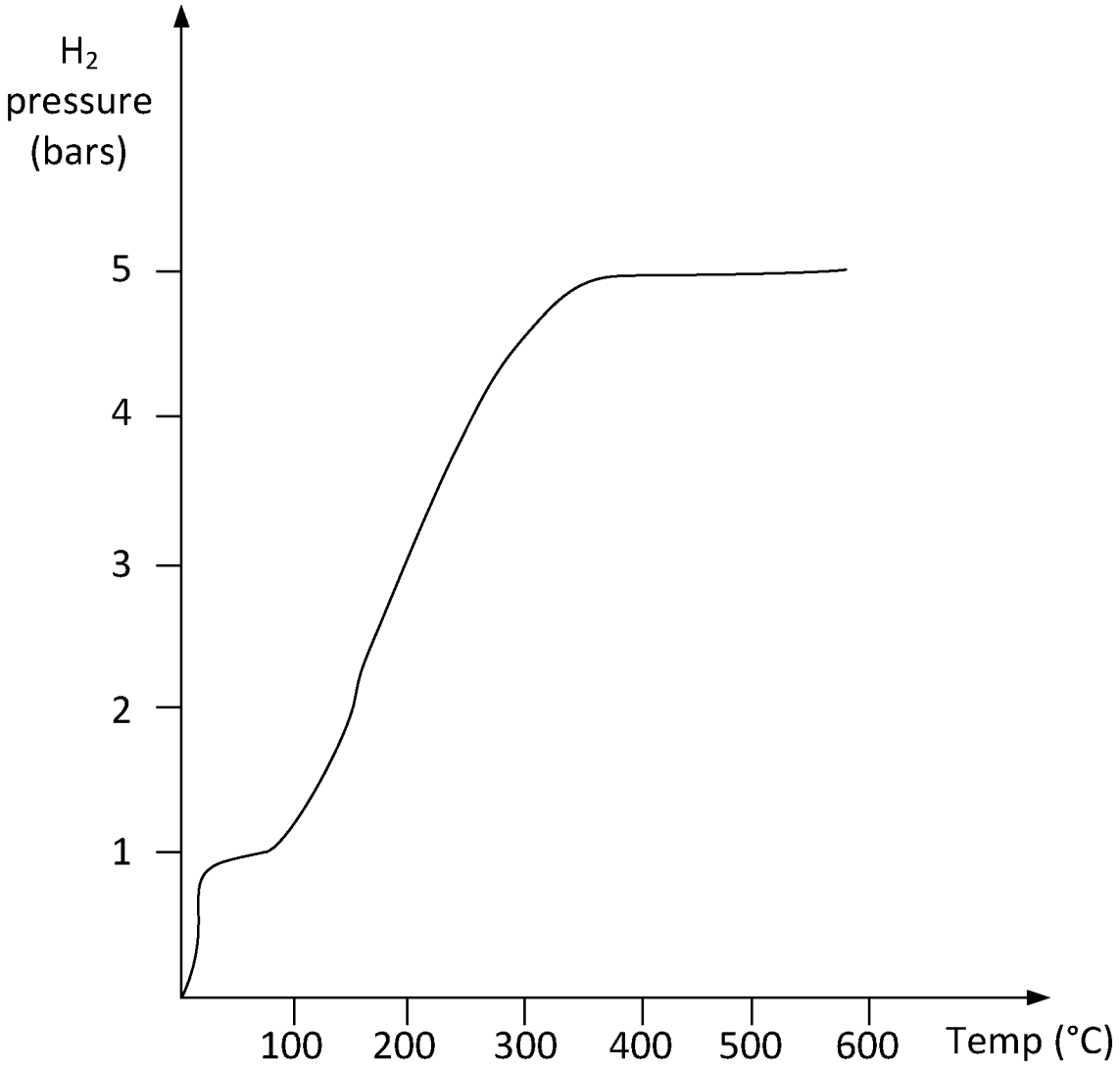
FIG. 4 is a chart showing a possible relation between $H_2$ pressure and temperature in a heated furnace space according to the present invention.

FIG. 3 illustrates a method according to the present invention, which method uses a system 100 of the type generally illustrated in FIG. 3 and in particular a furnace 100 of the type generally illustrated in FIGS. 1*a* and 1*b*. In particular, the method is for producing direct reduced metal material using hydrogen gas as the reducing agent.

After such direct reduction, the metal material may form sponge metal. In particular, the metal material may be iron oxide material, and the resulting product after the direct reduction may then be sponge iron. Such sponge iron may then be used, in subsequent method steps, to produce steel and so forth.

In a first step, the method starts.

In a subsequent step, the metal material to be reduced is charged into the furnace space 120. This charging may take place by a loaded container 140 being placed into the furnace space 120 in the orientation illustrated in FIGS. 1*a* and 1*b*, and the furnace space 120 may then be closed and sealed in a gas-tight manner using fastening means 111.

In a subsequent step, an existing atmosphere is evacuated from the furnace space 120, so that an underpressure is achieved inside the furnace space 120 as compared to atmospheric pressure. This may take place by valves 1-8, 11 and 13-14 being closed and valves 9-10 and 12 being open, and the vacuum pump sucking out and hence evacuating the contained atmosphere inside the furnace space 120 via the conduit passing via 240 and 250. Valve 9 may then be open to allow such evacuated gases to flow out into the surrounding atmosphere, in case the furnace space 120 is filled with air. If the furnace space 120 is filled with used hydrogen gas, this is instead evacuated to the container 280.

In this example, the furnace atmosphere is evacuated via conduit 173, even if it is realized that any other suitable exit conduit arranged in the furnace 100 may be used.

In this evacuation step, as well as in other steps as described below, the control device 201 may be used to control the pressure in the furnace space 120, such as based upon readings from pressure sensors 122, 123 and/or 124.

The emptying may proceed until a pressure of at the most 0.5 bar, preferably at the most 0.3 bar, is achieved in the furnace space 120.

In a subsequent initial heating step, heat and hydrogen gas is provided to the furnace space 120. The hydrogen gas may be supplied from the containers 280 and/or 290. Since the furnace 100 is closed, as mentioned above, substantially none of the provided hydrogen gas will escape during the process. In other words, the hydrogen gas losses (apart from hydrogen consumed in the reduction reaction) will be very low or even non-existent. Instead, only the hydrogen consumed chemically in the reduction reaction during the reduction process will be used. Further, the only hydrogen gas which is required during the reduction process is the necessary amount to uphold the necessary pressure and chemical equilibrium between hydrogen gas and water vapour during the reduction process.

As mentioned above, the container 290 holds fresh (unused) hydrogen gas, while container 280 holds hydrogen gas that has already been used in one or several reduction steps and has since been collected in the system 200. The first time the reduction process is performed, only fresh hydrogen gas is used, provided from container 290. During subsequent reduction processes, reused hydrogen gas, from container 280, is used, which is topped up by fresh hydrogen gas from container 290 according to need.

During an optional initial phase of the initial heating step, which initial phase is one of hydrogen gas introduction, performed without any heat provision up to a furnace space 120 pressure of about 1 bar, valves 2, 4-9, 11 and 13-14 are closed, while valves 10 and 12 are open. Depending on if fresh or reused hydrogen gas is to be used, valve V1 and/or V3 is open.

As the pressure inside the furnace space 120 reaches, or comes close to, atmospheric pressure (about 1 bar), the heating element 121 is switched on. Preferably, it is the heating element 121 which provides the said heat to the furnace space 120, by heating the supplied hydrogen gas, which in turn heats the material in the container 140. Preferably, the heating element 121 is arranged at a location past which the hydrogen gas being provided to the furnace space 120 flows, so that the heating element 121 will be substantially submerged in (completely or substantially completely surrounded by) newly provided hydrogen gas during the reducing process. In other words, the heat may advantageously be provided directly to the hydrogen gas which is concurrently provided to the furnace space 120. In FIGS. 1*a* and 1*b*, the preferred case in which the heating element 121 is arranged in a top part of the furnace space 120 is shown.

However, the present inventor foresee that the heat may be provided in other ways to the furnace space 120, such as directly to the gas mixture inside the furnace space 120 at a location distant from where the provided hydrogen gas enters the furnace space 120. In other examples, the heat may be provided to the provided hydrogen gas as a location externally to the furnace space 120, before the thus heated hydrogen gas is allowed to enter the furnace space 120.

During the rest of the said initial heating step, valves 5 and 7-14 are closed, while valves 1-4 and 6 are controlled by the control device, together with the compressor 270, to achieve a controlled provision of reused and/or fresh hydrogen gas as described in the following.

Hence, during this initial heating step, the control device 201 is arranged to control the heat and hydrogen provision means 121, 280, 290 to provide heat and hydrogen gas to the furnace space 120 in a way so that heated hydrogen gas heats the charged metal material to a temperature above the boiling temperature of water contained in the metal material. As a result, said contained water evaporates.

Throughout the initial heating step and the main heating step (see below), hydrogen gas is supplied slowly under the control of the control device 201. As a result, there will be a continuously present, relatively slow but steady, flow of hydrogen gas, vertically downwards, through the charged material. In general, the control device is arranged to continuously add hydrogen gas so as to maintain a desired increasing (such as monotonically increasing) pressure curve inside the furnace space 120, and in particular to counteract the decreased pressure at the lower parts of the furnace space 120 (and in the lower parts of the heat exchanger 160) resulting from the constant condensation of water vapour in the heat exchanger 160 (see below). The total energy consumption depends on the efficiency of the heat exchanger 160, and in particular its ability to transfer thermal energy to the incoming hydrogen gas from both the hot gas flowing through the heat exchanger 160 and the condensation heat of the condensing water vapour. In the exemplifying case of $Fe_2O_3$, the theoretical energy needed to heat the oxide, thermally compensate for the endothermic reaction and reduce the oxide is about 250 kWh per 1000 kg of $Fe_2O_3$. For $Fe_3O_4$, the corresponding number is about 260 kWh per 1000 kg of $Fe_3O_4$.

An important aspect of the present invention is that there is no recirculation of hydrogen gas during the reduction process. This has been discussed on a general level above, but in the example shown in FIG. 1*a* this means that the hydrogen gas is supplied, such as via compressor 270, through entry conduit 171 into the top part of the furnace space 121, where it is heated by the heating element 121 and then slowly passes downwards, past the metal material to be reduced in the container 140, further down through the heat exchanger 130 and into the trough 161. However, there are no available exit holes from the furnace space 120, and in particular not from the trough 161. The conduit 173 is closed, for instance by the valves V10, V12, V13, V14 being closed. Hence, the supplied hydrogen gas will be partly consumed in the reduction process, and partly result in an increased gas pressure in the furnace space 120. This process then goes on until a full or desired reduction has occurred of the metal material, as will be detailed below.

Hence, the heated hydrogen gas present in the furnace space 120 above the charged material in the container 140 will, via the slow supply of hydrogen gas forming a slowly moving downwards gas stream, be brought down to the charged material. There, it will form a gas mixture with water vapour from the charged material (see below).

The resulting hot gas mixture will form a gas stream down into and through the heat exchanger 160. In the heat exchanger 160, there will then be a heat exchange of heat from the hot gas arriving from the furnace space 120 to the cold newly provided hydrogen gas arriving from conduit 171, whereby the latter will be preheated by the former. In other words, hydrogen gas to be provided in the initial and main heating steps is preheated in the heat exchanger 160.

Due to the cooling of the hot gas flow, water vapour contained in the cooled gas will condense. This condensation results in liquid water, which is collected in the trough 161, but also in condensation heat. It is preferred that the heat exchanger 160 is further arranged to transfer such condensation thermal energy from the condensed water to the cold hydrogen gas to be provided into the furnace space 120.

The condensation of the contained water vapour will also decrease the pressure of the hot gas flowing downwards from the furnace space 120, providing space for more hot gas to pass downwards through the heat exchanger 160.

Due to the slow supply of additional heated hydrogen gas, and to the relatively high thermal conductivity of hydrogen gas, the charged material will relatively quickly, such as within 10 minutes or less, reach the boiling point of liquid water contained in the charged material, which should by then be slightly above 100° C. As a result, this contained liquid water will evaporate, forming water vapour mixing with the hot hydrogen gas.

The condensation of the water vapour in the heat exchanger 160 will decrease the partial gas pressure for the water vapour at the lower end of the structure, making the water vapour generated in the charged material on average flow downwards. Adding to this effect, water vapour also a substantially lower density than the hydrogen gas with which it mixes.

This way, the water contents of the charged material in the container 140 will gradually evaporate, flow downwards through the heat exchanger 160, cool down and condense therein and to up in liquid state in the trough 161.

It is preferred that the cold hydrogen gas supplied to the heat exchanger 160 is room tempered or has a temperature which is slightly less than room temperature.

It is realized that this initial heating step, in which the charged material is hence dried from any contained liquid water, is a preferred step in the present method. In particular, this makes it easy to produce and provide the charged material as a granular material, such as in the form of rolled balls of material, without having to introduce an expensive and complicating drying step prior to charging of the material into the furnace space 120.

However, it is realized that it would be possible to charge already dry or dried material into the furnace space 120. In this case, the initial heating step as described herein would not be performed, but the method would skip immediately to the main heating step (below).

In one embodiment of the present invention, the provision of hydrogen gas to the furnace space 120 during said initial heating step is controlled to be so slow so that a pressure equilibrium is substantially maintained throughout the performance of the initial heating step, preferably so that a substantially equal pressure prevails throughout the furnace space 120 and the not liquid-filled parts of the trough 161 at all times. In particular, the supply of hydrogen gas may be controlled so that the said equilibrium gas pressure does not increase, or only increases insignificantly, during the initial heating step. In this case, the hydrogen gas supply is then controlled to increase the furnace space 120 pressure over time only after all or substantially all liquid water has evaporated from the charged material in the container 140. The point in time when this has occurred may, for instance, be determined as a change upwards in slope of a temperature-to-time curve as measured by temperature sensor 123 and/or 124, where the change of slope marks a point at which substantially all liquid water has evaporated but the reduction has not yet started. Alternatively, hydrogen gas supply may be controlled so as to increase the pressure once a measured temperature in the furnace space 120, as measured by temperature sensor 123 and/or 124, has exceeded a predetermined limit, which limit may be between 100° C. and 150° C., such as between 120° C. and 130° C.

In a subsequent main heating step, heat and hydrogen gas is further provided to the furnace space 120, in a manner corresponding to the supply during the initial heating step described above, so that heated hydrogen gas heats the charged metal material to a temperature high enough in order for metal oxides present in the metal material to be reduced, in turn causing water vapour to be formed.

During this main heating step, additional hydrogen gas is hence supplied and heated, under a gradual pressure increase inside the furnace space 120, so that the charged metal material in turn is heated up to a temperature at which a reduction chemical reaction is initiated and maintained.

In the example illustrated in FIGS. 1*a* and 1*b*, the topmost charged material will hence be heated first. In the case of iron oxide material, the hydrogen gas will start reducing the charged material to form metallic iron at about 350-400° C., forming pyrophytic iron and water vapour according to the following formulae:

$$Fe_2O_3+3H_2=2Fe+3H_2O$$

$$Fe_3O_4+4H_2=2Fe+4H_2O$$

This reaction is endothermal, and is driven by the thermal energy supplied via the hot hydrogen gas flowing down from above in the furnace space 120.

Hence, during both the initial heating step and the main heating step, water vapour is produced in the charged material. This formed water vapour is continuously condensed and collected in a condenser arranged below the charged metal material. In the example shown in FIG. 1*a*, the condenser is in the form of the heat exchanger 160.

According to the invention, the main heating step, including said condensing, is performed until an overpressure has been reached in the furnace space 120 in relation to atmospheric pressure. The pressure may, for instance, be measured by pressure sensor 123 and/or 124. As mentioned above, according to the invention no hydrogen gas is evacuated from the furnace space 120 until said overpressure has been reached, and preferably no hydrogen gas is evacuated from the furnace space 120 until the main heating step has been completely finalized.

More preferably, the supply of hydrogen gas in the main heating step, and the condensing of water vapour, is performed until a predetermined overpressure has been reached in the furnace space 120, which predetermined overpressure is at least 4 bars, more preferably at least 8 bars, or even about 10 bars in absolute terms.

Alternatively, the supply of hydrogen gas in the main heating step, and the condensing of water vapour, may be performed until a steady state has been reached, in terms of it no longer being necessary to provide more hydrogen gas in order to maintain a reached steady state gas pressure inside the furnace space 120. This pressure may be measured in the corresponding way as described above. Preferably, the steady state gas pressure may be at least 4 bars, more preferably at least 8 bars, or even about 10 bars. This way, a simple way of knowing when the reduction process has been completed is achieved.

Alternatively, the supply of hydrogen gas and heat in the main heating step, and the condensing of water vapour, may be performed until the charged metal material to be reduced has reached a predetermined temperature, which may be at least 600° C., such as between 640-680° C., preferably about 660° C. The temperature of the charged material may be measured directly, for instance by measuring heat radiation from the charged material using as suitable sensor, or indirectly by temperature sensor 123.

In some embodiments, the main heating step, including said condensation of the formed water vapour, is performed during a continuous time period of at least 0.25 hours, such as at least 0.5 hours, such as at least 1 hour. During this whole time, both the pressure and temperature of the furnace space 120 may increase monotonically.

In some embodiments, the main heating step may furthermore be performed iteratively, in each iteration the control device 201 allowing a steady state pressure to be reached inside the furnace space 120 before supplying an additional amount of hydrogen gas into the furnace space. The heat provision may also be iterative (pulsed), or be in a switched on state during the entire main heating step.

It is noted that, during the performing of both the initial heating step and the main heating steps, and in particular at least during substantially the entire length of these steps, there is a net flow downwards of water vapour through the charged metal material in the container 140.

During the initial and main heating steps, the compressor 270 is controlled, by the control device 201, to, at all times, maintain or increase the pressure by supplying additional hydrogen gas. This hydrogen gas is used to compensate for hydrogen consumed in the reduction process, and also to gradually increase the pressure to a desired final pressure.

The formation of water vapour in the charged material increases the gas pressure locally, in effect creating a pressure variation between the furnace space 120 and the trough 161. As a result, formed water vapour will sink down through the charged material and condense in the heat exchanger 160, in turn lowering the pressure on the distant (in relation to the furnace space 120) side of the heat exchanger 160. These processes thus create a downwards net movement of gas through the charge, where newly added hydrogen gas compensates for the pressure loss in the furnace space 120.

The thermal content in the gas flowing out from the furnace space 120, and in particular the condensing heat of the water vapour, is transferred to the incoming hydrogen gas in the heat exchanger 160.

Hence, this process is maintained as long as there is metal material to reduce and water vapour hence is produced, resulting in said downwards gas movement. Once the production of water vapour stops (due to substantially all metal material having been reduced), the pressure equalizes throughout the interior of the furnace 100, and the measured temperature will be similar throughout the furnace space 120. For instance, a measured pressure difference between a point in the gas-filled part of the trough 161 and a point above the charged material will be less than a predetermined amount, which may be at the most 0.1 bars. Additionally or alternatively, a measured temperature difference between a point above the charged material and a point below the charged material but on the furnace space 120 side of the heat exchanger will be less than a predetermined amount, which may be at the most 20° C. Hence, when such pressure and/or temperature homogeneity is reached and measured, the main heating step may end by the hydrogen gas supply being shut off and the heating element 121 being switched off.

Hence, the main heating step may be performed until a predetermined minimum temperature and/or pressure has been reached, and/or until a predetermined maximum temperature difference and/or maximum pressure difference has been reached in the heated volume in the furnace 100. Which criterion(s) is/are used depends on the prerequisites, such as the design of the furnace 100 and the type of metal material to be reduced. It is also possible to use other criteria, such as a predetermined main heating time or the finalization of a predetermined heating/hydrogen supply program, which in turn may be determined empirically.

In a subsequent cooling step, the hydrogen atmosphere in the furnace space 120 is then cooled to a temperature of at the most 100° C., preferably about 50° C., and is thereafter evacuated from the furnace space 120 and collected.

In the case of a single furnace 100/220, which is not connected to one or several furnaces, the charged material may be cooled using the fan 250, which is arranged downstream of the gas-water type cooler 240, in turn being arranged to cool the hydrogen gas (circulated in a closed loop by the fan 250 in a loop past the valve V12, the heat exchanger 240, the fan 250 and the valve V10, exiting the furnace space 120 via exit conduit 173 and again entering the furnace space 120 via entry conduit 171). This cooling circulation is shown by the arrows in FIG. 1*b*.

The heat exchanger 240 hence transfers the thermal energy from the circulated hydrogen gas to water (or a different liquid), from where the thermal energy can be put to use in a suitable manner, for instance in a district heating system. The closed loop is achieved by closing all valves V1-V14 except valves V10 and V12.

Since the hydrogen gas in this case is circulated past the charged material in the container 140, it absorbs thermal energy from the charged material, providing efficient cooling of the charged material while the hydrogen gas is circulated in a closed loop.

In a different example, the thermal energy available from the cooling of the furnace 100/220 is used to preheat a different furnace 210. This is then achieved by the control device 201, as compared to the above described cooling closed loop, closing the valve V12 and instead opening valves V13, V14. This way, the hot hydrogen gas arriving from the furnace 220 is taken to the gas-gas type heat exchanger 230, which is preferably a counter-flow heat exchanger, in which hydrogen gas being supplied in an initial or main heating step performed in relation to the other furnace 210 is preheated in the heat exchanger 230. Thereafter, the somewhat cooled hydrogen gas from furnace 220 may be circulated past the heat exchanger 240 for further cooling before being reintroduced into the furnace 220. Again, the hydrogen gas from furnace 220 is circulated in a closed loop using the fan 250.

Hence, the cooling of the hydrogen gas in the cooling step may take place via heat exchange with hydrogen gas to be supplied to a different furnace 210 space 120 for performing the initial and main heating steps and the condensation, as described above, in relation to said different furnace 210 space 120.

Once the hydrogen gas is insufficiently hot to heat the hydrogen gas supplied to furnace 210, the control device 201 again closes valves V13, V14 and reopens valve V12, so that the hydrogen gas from furnace 220 is taken directly to heat exchanger 240.

Irrespectively of how its thermal energy is taken care of, the hydrogen gas from furnace 220 is cooled until it (or, more importantly, the charged material) reaches a temperature of below 100° C., in order to avoid reoxidation of the charged material when later being exposed to air. The temperature of the charged material can be measured directly, in a suitable manner such as the one described above, or indirectly, by measuring in a suitable manner the temperature of the hydrogen gas leaving via exit conduit 173.

The cooling of the hydrogen gas may take place while maintaining the overpressure of the hydrogen gas, or the pressure of the hydrogen gas may be lowered as a result of the hot hydrogen gas being allowed to occupy a larger volume (of the closed loop conduits and heat exchangers) once valves V10 and V12 are opened.

In a subsequent step, the hydrogen gas is evacuated from the furnace 220 space 120, and collected in container 280. This evacuation may be performed by the vacuum pump 260, possibly in combination with the compressor 270, whereby the control device opens valves V3, V5, V6, V8, V10 and V12, and closes the other valves, and operates the vacuum pump 260 and compressor 270 to displace the cooled hydrogen gas to the container 280 for used hydrogen gas. The evacuation is preferably performed until a pressure of at the most 0.5 bars, or even at the most 0.3 bars, is detected inside the furnace space 120.

Since the furnace space 120 is closed, only the hydrogen gas consumed in the chemical reduction reaction has been removed from the system, and the remaining hydrogen gas is the one which was necessary to maintain the hydrogen gas/water vapour balance in the furnace space 120 during the main heating step. This evacuated hydrogen gas is fully useful for a subsequent batch operation of a new charge of metal material to be reduced.

In a subsequent step, the furnace space 120 is opened, such as by releasing the fastening means 111 and opening the upper part 110. The container 140 is removed and is replaced with a container with a new batch of charged metal material to be reduced.

In a subsequent step, the removed, reduced material may then be arranged under an inert atmosphere, such as a nitrogen atmosphere, in order to avoid reoxidation during transport and storage.

For instance, the reduced metal material may be arranged in a flexible or rigid transport container which is filled with inert gas. Several such flexible or rigid containers may be arranged in a transport container, which may then be filled with inert gas in the space surrounding the flexible or rigid containers. Thereafter, the reduced metal material can be transported safely without running the risk of reoxidation.

The following table shows the approximate equilibrium between hydrogen gas $H_2$ and water vapour $H_2O$ for different temperatures inside the furnace space 120:

| Temperature (° C.): | 400 | 450 | 500 | 550 | 600 |
|---|---|---|---|---|---|
| $H_2$ (vol-%): | 95 | 87 | 82 | 78 | 76 |
| $H_2O$ (vol-%): | 5 | 13 | 18 | 22 | 24 |

At atmospheric pressure, about 417 $m^3$ hydrogen gas $H_2$ is required to reduce 1000 kg of $Fe_2O_3$, and about 383 $m^3$ hydrogen gas $H_2$ is required to reduce 1000 kg of $Fe_3O_4$.

The following table shows the amount of hydrogen gas required to reduce 1000 kg of $Fe_2O_3$ and $Fe_3O_4$, respectively, at atmospheric pressure and in an open system (according to the prior art), but at different temperatures:

| Temperature (° C.): | 400 | 450 | 500 | 550 | 600 |
|---|---|---|---|---|---|
| $Nm^3$ $H_2$/tonne $Fe_2O_3$: | 8340 | 3208 | 2317 | 1895 | 1738 |
| $Nm^3$ $H_2$/tonne $Fe_3O_4$: | 7660 | 2946 | 2128 | 1741 | 1596 |

The following table shows the amount of hydrogen gas required to reduce 1000 kg of $Fe_2O_3$ and $Fe_3O_4$, respectively, at different pressures and for different temperatures:

| Temperature (° C.): | 400 | 450 | 500 | 550 | 600 |
|---|---|---|---|---|---|
| $Nm^3$ $H_2$/tonne $Fe_2O_3$: | | | | | |
| 1 bar | 8340 | 3208 | 2317 | 1895 | 1738 |
| 2 bars | 4170 | 1604 | 1158 | 948 | 869 |
| 3 bars | 2780 | 1069 | 772 | 632 | 579 |
| 4 bars | 2085 | 802 | 579 | 474 | 434 |
| 5 bars | 1668 | 642 | 463 | 379 | 348 |
| 6 bars | 1390 | 535 | 386 | 316 | 290 |
| $Nm^3$ $H_2$/tonne $Fe_3O_4$: | | | | | |
| 1 bar | 7660 | 2946 | 2128 | 1741 | 1596 |
| 2 bars | 3830 | 1473 | 1064 | 870 | 798 |
| 3 bars | 2553 | 982 | 709 | 580 | 532 |
| 4 bars | 1915 | 737 | 532 | 435 | 399 |
| 5 bars | 1532 | 589 | 426 | 348 | 319 |
| 6 bars | 1277 | 491 | 355 | 290 | 266 |

As described above, the main heating step according to the present invention is preferably performed up to a high pressure and a high temperature. During the majority of the main heating step, it has been found advantageous to use a combination of a heated hydrogen gas temperature of at least 500° C. and a furnace space 120 pressure of at least 5 bars.

Above, preferred embodiments have been described. However, it is apparent to the skilled person that many modifications can be made to the disclosed embodiments without departing from the basic idea of the invention.

For instance, the geometry of the furnace 100 may differ, depending on the detailed prerequisites.

The heat exchanger 160 is described as a tube heat exchanger. Even if this has been found to be particularly advantageous, it is realized that other types of gas-gas heat exchangers/condensers are possible. Heat exchanger 240 may be of any suitable configuration.

The surplus heat from the cooled hydrogen gas may also be used in other processes requiring thermal energy.

The metal material to be reduced has been described as iron oxides. However, the present method and system can also be used to reduce metal material such as the above mentioned metal oxides, such as of Zn and Pb, that evaporate at temperatures below about 600° C.

The present direct reduction principles can also be used with metal materials having higher reduction temperatures than iron ore, with suitable adjustments to the construction of the furnace 100, such as with respect to used construction materials.

Hence, the invention is not limited to the described embodiments, but can be varied within the scope of the enclosed claims.

The invention claimed is:

1. A method for batchwise production of direct reduced metal material in a furnace that is part of a closed system, the furnace including a heated furnace space, the method comprising the steps:

a) charging metal material to be reduced into the furnace space;

b) evacuating an existing atmosphere from the furnace space so as to achieve an underpressure inside the furnace space;

c) providing, in a main heating step, heat and hydrogen gas to the furnace space, so that heated hydrogen gas heats the charged metal material and reduces metal oxides present in the metal material, in turn causing water vapor to be formed; and d) condensing and collecting the water vapor formed in step c in a condenser below the charged metal material;

wherein the hydrogen gas in step c is provided without recirculation of the hydrogen gas and without removing the hydrogen gas from the furnace during the reduction of the charged metal material, and wherein the method further comprises a subsequently performed step of removing the reduced metal material from the furnace space, and at least one of storing or transporting the reduced metal material under an inert atmosphere.

2. The method according to claim 1, wherein steps c and d are performed at least until a hydrogen atmosphere overpressure has been reached inside the furnace space.

3. The method according to claim 1, wherein the material charged in step a is at the most 50 tons.

4. The method according to claim 1, wherein the closed system is provided directly at a mining site and the direct reduced metal material is packaged at the mining site under a protecting atmosphere and thereafter transported to a different site for further processing.

5. The method according to claim 1, wherein the method further comprises cooling the charged material, after step d, by circulating the hydrogen gas past the charged material, so that the hydrogen gas is heated by the charged material and cooled by heat exchange using a heat exchanger.

6. The method according to claim 5, wherein the cooling of the charged material is performed until the charged material reaches a temperature of below 100° C.

7. The method according to claim 1, wherein the inert atmosphere is a nitrogen atmosphere.

8. The method according to claim 1, wherein the method further comprises the step of providing the reduced metal material into a first transport container which is filled with inert gas, wherein several such first transport containers are provided into a second transport container, in turn being filled with inert gas in the space surrounding the first transport containers.

9. The method according to claim 1, wherein step c further comprises, in an initial heating step, providing heat and hydrogen gas to the furnace space, so that heated hydrogen gas heats the charged metal material to a temperature above a boiling temperature of water contained in the metal material, causing the contained water to evaporate.

10. The method according to claim 1, wherein hydrogen gas to be provided in step c is preheated in a heat exchanger, which heat exchanger is arranged to transfer thermal energy from the evaporated water to the hydrogen gas to be provided in step c.

11. The method according to claim 1, wherein the main heating step of step c and the condensing in step d are performed until a predetermined pressure has been reached.

12. The method according to claim 1, wherein the main heating step in step c and the condensing in step d are performed until a steady state is reached, in terms of it no longer being necessary to provide more hydrogen gas in order to maintain a reached steady state gas pressure inside the furnace space.

13. The method according to claim 1, wherein the main heating step in step c and the condensing in step d are performed until the charged metal material to be reduced has reached a predetermined temperature.

14. The method according to claim 1, wherein, during the performing of step c, there is a net flow downwards of water vapor through the charged metal material.

15. The method according to claim 1, wherein the method further comprises the steps of e) after steps c and d are finished, cooling the hydrogen atmosphere to at the most 100° C.; and f) after step e is finished, evacuating the hydrogen atmosphere from the furnace space and collecting the hydrogen gas of the evacuated hydrogen atmosphere.

16. The method according to claim 1, wherein steps c and d are performed during at least 0.25 hours.

* * * * *